US006220793B1

(12) United States Patent
Meyer

(10) Patent No.: US 6,220,793 B1
(45) Date of Patent: Apr. 24, 2001

(54) APPARATUS FOR GUIDING PNEUMATICALLY CONVEYED TEXTILE FIBER TUFTS

(75) Inventor: Günter Meyer, Viersen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/301,306

(22) Filed: Apr. 29, 1999

(30) Foreign Application Priority Data

May 9, 1998 (DE) ..... 198 20 914

(51) Int. Cl.[7] ..... B65G 51/24
(52) U.S. Cl. ..... 406/183; 137/872; 406/181
(58) Field of Search ..... 406/183, 181; 137/872

(56) References Cited

U.S. PATENT DOCUMENTS

| | | | | |
|---|---|---|---|---|
| 3,334,947 | * | 8/1967 | Orsi . | |
| 3,860,031 | * | 1/1975 | Grilli | 406/183 |
| 3,873,164 | | 3/1975 | Griffin, Jr. et al. | 406/183 |
| 4,506,704 | * | 3/1985 | Boom et al. | 137/883 |
| 4,763,792 | * | 8/1988 | Kind | 209/570 |

FOREIGN PATENT DOCUMENTS

| | | |
|---|---|---|
| 446 972 | 3/1968 | (CH) . |
| 582 873 | 8/1933 | (DE) . |
| 1 481 025 | 2/1969 | (DE) . |
| 1 918 544 | 10/1969 | (DE) . |
| 0152 108 | 11/1981 | (DE) . |
| 297 11 309 | 12/1997 | (DE) . |
| 359 623 | 10/1931 | (GB) . |
| 1 560 447 | 2/1980 | (GB) . |

* cited by examiner

*Primary Examiner*—Christopher P. Ellis
*Assistant Examiner*—Richard Ridley
(74) *Attorney, Agent, or Firm*—Venable; Gabor J. Kelemen

(57) ABSTRACT

A device for channeling a pneumatically conveyed fiber tuft stream includes a housing defining a chamber; a main conduit merging into the chamber for guiding the fiber tuft stream into the chamber; first and second branch conduits extending from the chamber for guiding the fiber tuft stream out of the chamber; first and second air intake openings provided in the housing for allowing air, situated externally of the main conduit, to be drawn into the first and second branch conduits; and a routing gate assembly disposed in the chamber and including first and second routing gates each having a surface cooperating with respective first and second air intake openings. The routing gate assembly has a first operational state for channeling the flow from the main conduit simultaneously into the first and second branch conduits; a second operational state for channeling the flow from the main conduit solely into the first branch conduit; and a third operational state for channeling the flow from the main conduit solely into the second branch conduit. In the second and third operational states one of the first and second routing gates blocks directly one of the first and second air intake openings with the surface of the routing gate.

8 Claims, 3 Drawing Sheets

APPARATUS FOR GUIDING PNEUMATICALLY CONVEYED TEXTILE FIBER TUFTS

CROSS REFERENCE TO RELATED APPLICATION

This application claims the priority of German Application No. 198 20 914.2 filed May 9, 1998, which is incorporated herein by reference.

FIELD OF THE INVENTION

This invention relates to an apparatus for channeling pneumatically transported textile fiber tufts such as cotton or chemical fiber tufts from a main conduit into at least one of two branch conduits by movable routing gates. In the region of the location where the branch conduits extend from the main conduit, an aperture for intake air is provided whose control element (closing and opening element) is coupled with the drive of the routing gates.

TECHNOLOGY REVIEW

When fiber tufts are conveyed pneumatically, the fiber material is entrained by a conveying gas, for example, air, through a conduit which introduces the fiber tufts into a fiber processing machine. Fiber tufts are often processed by a fiber processing line composed of a plurality of simultaneously operating, serially and/or parallel-connected fiber processing machines, such as fiber bale openers, cleaners, card feeders, carding machines and mixers which are interconnected by tuft conveying conduits. For supplying the pneumatically conveyed tufts to parallel-connected machines, from a main conduit two branch conduits extend, and a 2-way tuft distributing device (channeling or routing device) is inserted between the main conduit and the branch conduits.

The 2-way distributing device includes two routing gates, by means of which the fiber tuft-laden conveying stream flowing through the main conduit may be directed into either the first branch conduit (by closing the second branch conduit) or into the second branch conduit (by closing the first branch conduit) or into both branch conduits (by maintaining both branch conduits open). The main conduit and the two branch conduits have essentially identical diameters. If the entire conveying stream is channeled into only one of the two branch conduits, the flow rate in the active branch conduit is identical to that in the main conduit, that is, the entire conveying air quantity of the main conduit is available for conveyance in the branch conduit. If, however, the conveying stream is split to flow in both branch conduits, then in each branch conduit the flow rate of air is only one half of that in the main conduit, and consequently, such halved flow rates may be insufficient to fulfill its conveying function of air for the after-connected fiber processing machines. Therefore, in the region of the 2-way distributing device, as a rule, at least one air intake opening is provided through which an air quantity is drawn such that in both branch conduits the flow rate of air will essentially equal that in the main conduit. The air intake opening is closed if fiber tufts are conveyed only in one of the two branch conduits.

In a known device the intake opening is provided in the ceiling wall of the 2-way distributing device. Each routing gate is rotatably supported along one edge thereof and each is adjoined by a closure element. If the conveying stream is directed into only one of the two branch conduits, the other branch conduit is closed by one of the routing gates and at the same time the associated closure element obturates the air intake opening. The same applies to the other branch conduit. When the conveying stream flows in both branch conduits, in which case the two routing gates maintain both branch conduits open, the two closure elements coupled with the respective routing gates are both spaced from the air intake opening which thus remains open.

Such a conventional arrangement is disadvantageous in that it uses additional closure elements and further, their mechanical operation involves substantial structural outlay. Complex structure, assembly and substantial spatial requirement are particular drawbacks. It is a further disadvantage that the flat closure elements are situated above one another and therefore cause certain leakage losses.

SUMMARY OF THE INVENTION

It is an object of the invention to provide an improved flow channeling device of the above-outlined type from which the discussed disadvantages are eliminated and which is structurally particularly simple and provides for a better guidance of the air stream.

This object and others to become apparent as the specification progresses, are accomplished by the invention, according to which, briefly stated, the device for channeling a pneumatically conveyed fiber tuft stream includes a housing defining a chamber; a main conduit merging into the chamber for guiding the fiber tuft stream into the chamber; first and second branch conduits extending from the chamber for guiding the fiber tuft stream out of the chamber; first and second air intake openings provided in the housing for allowing air, situated externally of the main conduit, to be drawn into the first and second branch conduits; and a routing gate assembly disposed in the chamber and including first and second routing gates each having a surface cooperating with respective first and second air intake openings. The routing gate assembly has a first operational state for channeling the flow from the main conduit simultaneously into the first and second branch conduits; a second operational state for channeling the flow from the main conduit solely into the first branch conduit; and a third operational state for channeling the flow from the main conduit solely into the second branch conduit. In the second and third operational states one of the first and second routing gates blocks directly one of the first and second air intake openings with the surface of the routing gate.

By virtue of the fact that each air intake opening may be opened and closed by the associated routing gate itself, each routing gate performs simultaneously several functions: it channels the fiber stream, blocks or opens a branch conduit and blocks or opens the associated air intake opening. In contrast to the known device, separately provided closure elements and their coupling to the routing gates are dispensed with. In addition to the simplification of structure and assembly as well as space saving, a further advantage of the invention resides in the elimination of leakage losses, because each routing gate itself provides for a reliable closure of its own air intake opening.

The invention has the following additional advantageous features:

- At least one pneumatic cylinder is used for pivoting the routing gates.
- The size of the air intake opening is adjustable and is controlled by a slide or the like.
- Between each routing gate and the associated air intake opening a seal is provided which is arranged on that surface of the routing gate which is oriented towards the air intake opening or is arranged in the inner wall face of the housing in the region of the air intake opening.

The wall faces which contain the air intake openings and the associated routing gates are oriented to one another at an acute angle when conveyance in both branch conduits takes place.

During conveyance in one branch conduit, one routing gate hermetically closes the other branch conduit and the other routing gate hermetically closes the air intake opening associated with the active branch conduit.

DESCRIPTION OF THE PREFERRED EMBODIMENT

Figure 1:
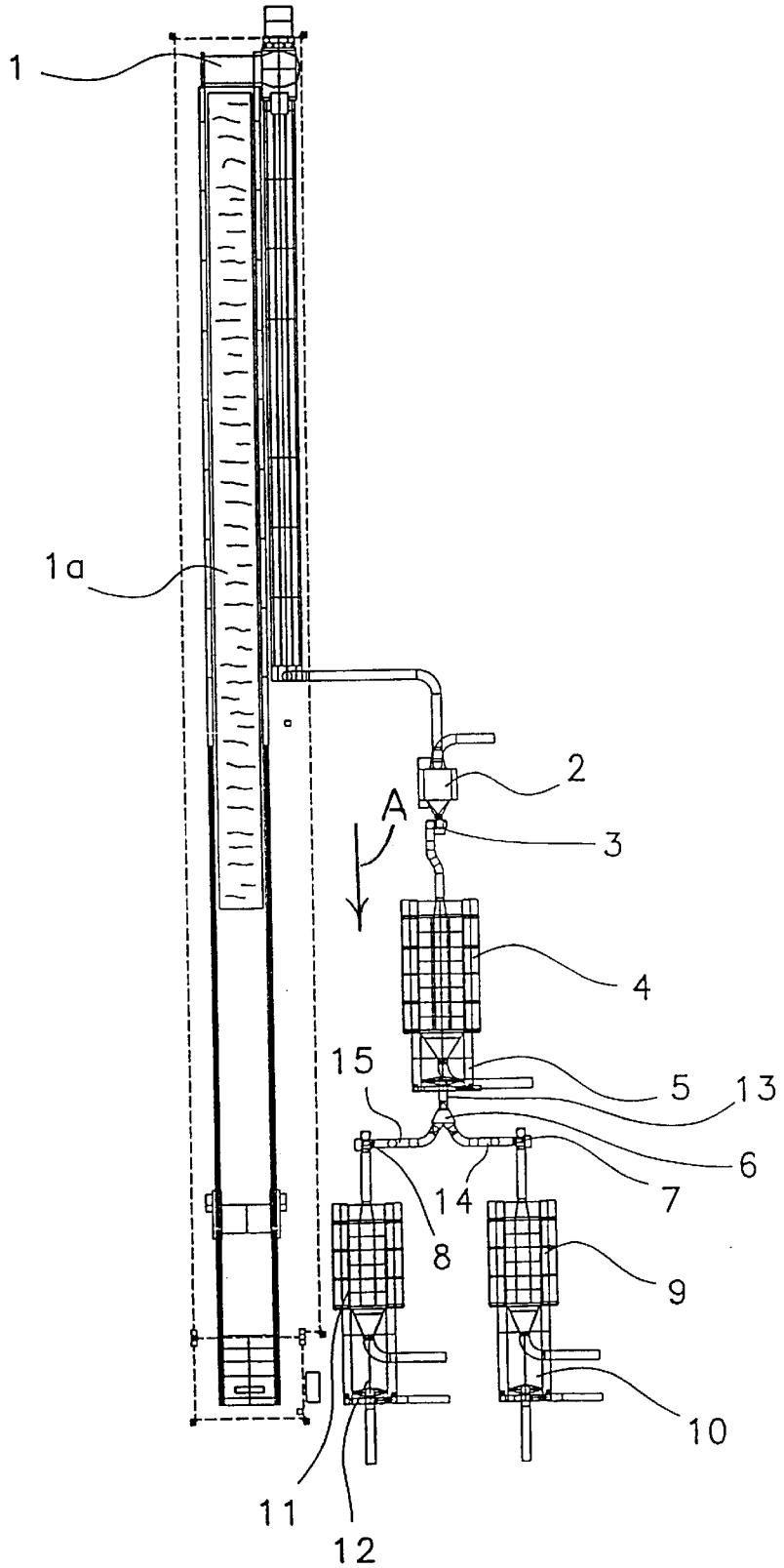
FIG. 1 is a schematic top plan view of a spinning preparation line incorporating the invention.

FIG. 1 schematically shows a spinning preparation (fiber processing) line which is composed of an automatic bale opener 1 which may be, for example, a BLENDOMAT BDT 020 model manufactured by Trützschler GmbH & Co. KG, Mönchengladbach, Germany, a high-capacity condenser 2, fiber-transporting blowers 3, 7 and 8, multiple mixers 4, 9 and 11, cleaners 5, 10 and 12 and a 2-way fiber flow distributing device (routing or channeling device) 6 structured according to the invention. The individual machines of the fiber processing line are interconnected by pneumatic conduits through which fiber tufts are pneumatically conveyed by the blowers as they are removed from the fiber bales 1*a* by the fiber bale opener 1. The fiber tufts first pass through the main conduit 13 and then are directed into the branch conduit 14 and/or 15 by means of the channeling device 6. The direction of fiber processing in the fiber processing line is designated by the arrow A.

Figure 2A:
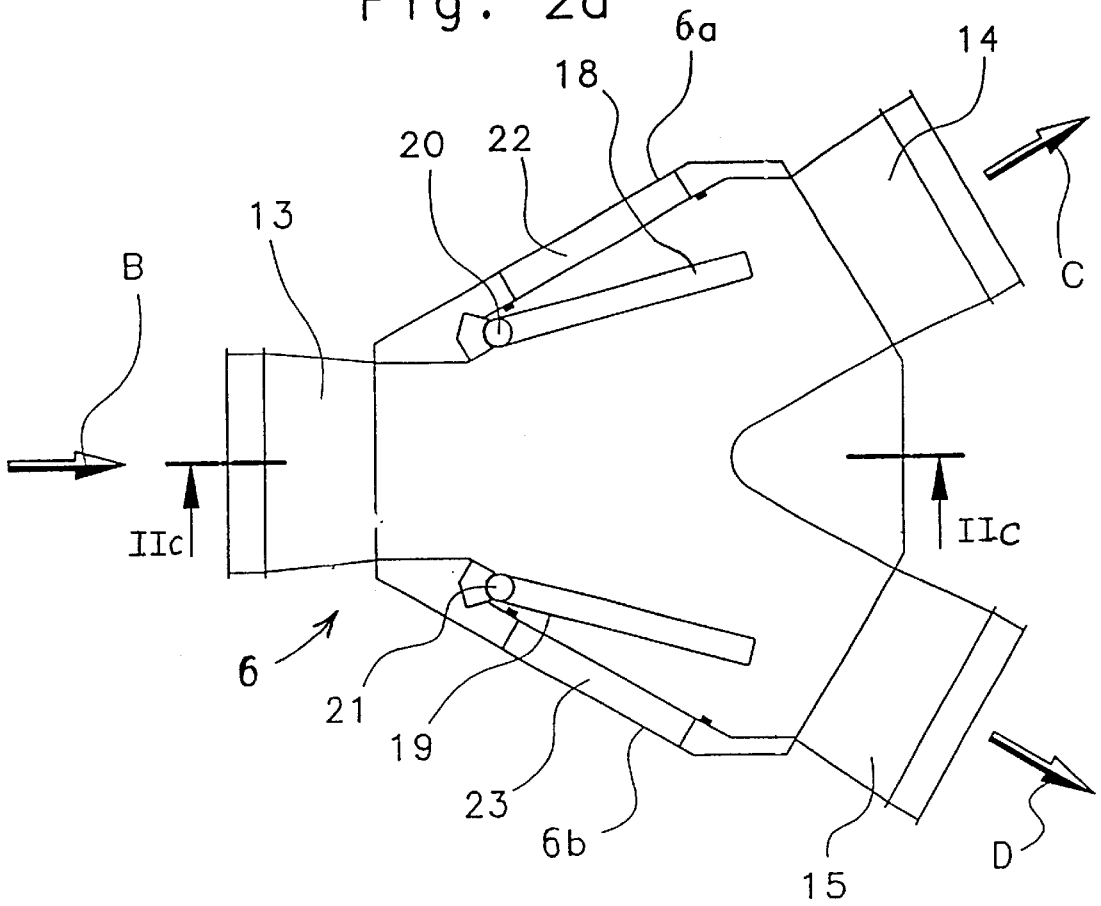
FIG. 2*a* is a sectional top plan view of a preferred embodiment of the invention.

The 2-way distributing device 6, as shown in FIG. 2*a*, has a main conduit 13 and two branch conduits 14 and 15. The fiber tuft/air mixture symbolized by the arrow B enters the 2-way distributing device 6 and, dependent upon the position of the routing structure to be discussed in greater detail later, the fiber tuft/air mixture exits the device 6 through the branch conduit 14 as a stream C and/or through the branch conduit 15 as stream D.

In the inner chamber of the distributing device 6 two routing gates 18 and 19 are disposed which are cantilevered to respective housing side walls 6*a* and 6*b* by respective pivot pins 20 and 21 for pivotal motions. Air intake openings 22 and 23 are provided in the respective walls 6*a* and 6*b* to face the associated routing gates 18 and 19.

Figure 2B:
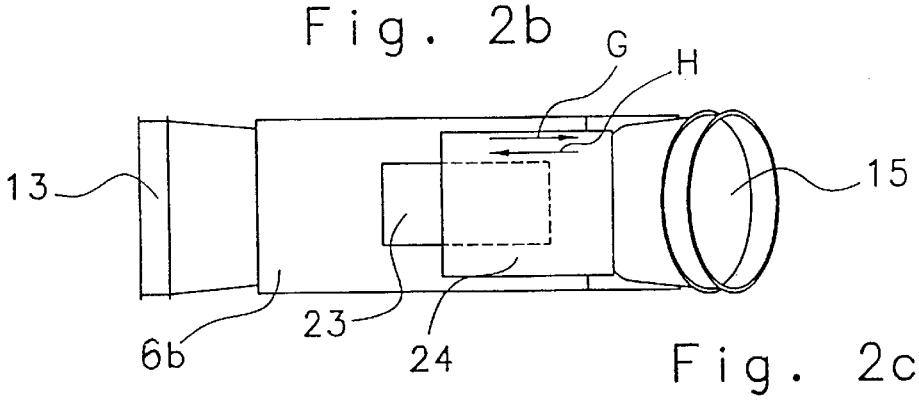
FIG. 2*b* is a side elevational view of the structure shown in FIG. 2*a*.

As seen in FIG. 2*b*, on the side wall 6*b* a slide 24 is mounted which, by shifting it in the direction of the arrows G and H varies the size (air passage area) of the air intake opening 23. The other air intake opening 22 may be similarly controlled by a slide (not shown) mounted on the side wall 6*a*.

Figure 2C:
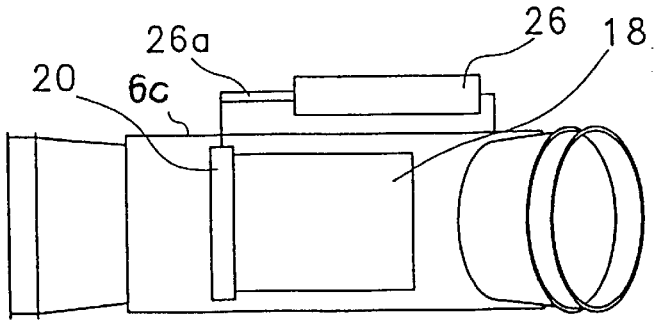
FIG. 2*c* is a partial sectional view taken along line IIc—IIc of FIG. 2*a*.

Turning to FIG. 2*c*, above the top housing wall 6*c* of the device 6 a pneumatic cylinder 26 is arranged whose push rod 26*a* is coupled, for example, by a non-illustrated crank or a rack-and-pinion device, to the pivot pin 20 of the routing gate 18. In this manner, the pivot pin 20 may be rotated and thus the routing gate 18 may be swung in the direction of the arrows I, K as shown in FIG. 3*c*. A similar, non-illustrated pneumatic driving arrangement is associated with the routing gate 19 to swing the same in the direction of the arrows L and M as likewise illustrated in FIG. 3*c*. The pneumatic cylinders are coupled to a non-illustrated electronic control and regulating device or a switching device by means of which the position of the routing gates 18 and 19 may be set.

Figure 3A:
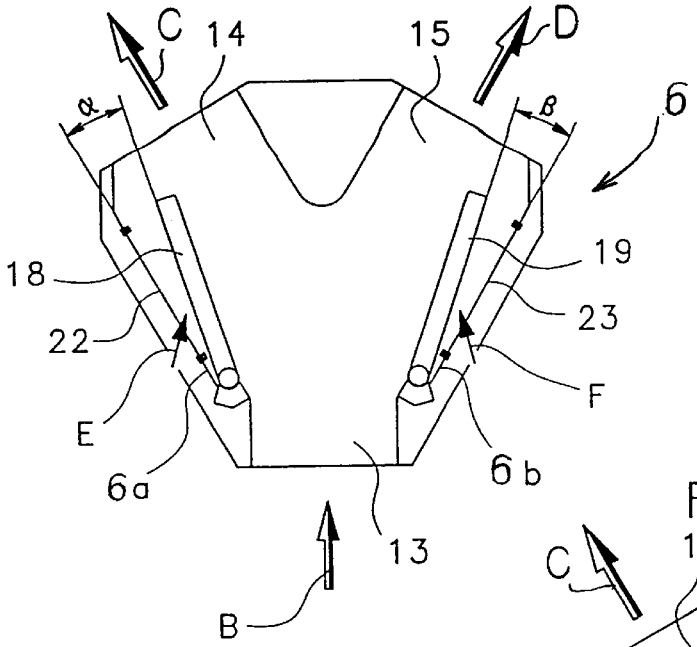
FIGS. 3*a*, 3*b* and 3*c* are sectional top plan views showing different operational positions of the preferred embodiment.
Figure 3B:
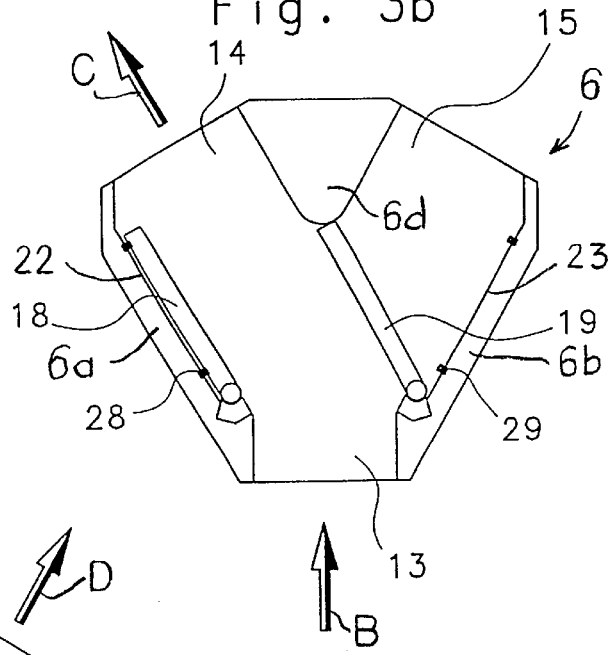
Figure 3C:
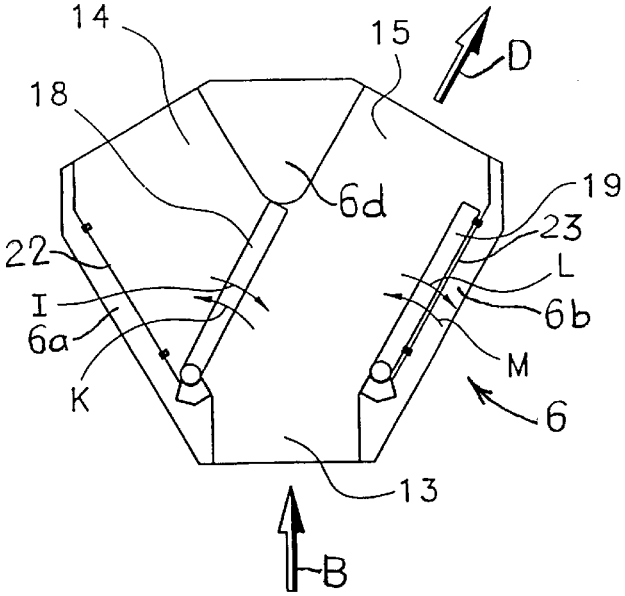

FIGS. 3*a*, 3*b* and 3*c* show three different settings of the fiber distributing device 6.

According to FIG. 3*a* the routing gates 18 and 19 are pivoted into such a position that both branch conduits 14 and 15 communicate with the main conduit 13 and further, the routing gates 18 and 19 are spaced from the respective air intake openings 22 and 23, since the routing gates 18 and 19 are inclined at respective acute angles $\alpha$ and $\beta$ to the respective wall faces 6*a* and 6*b*. In this position of the routing gates 18 and 19 the fiber tuft conveying air stream is directed simultaneously into both branch conduits 14 and 15. Further, the air intake openings 22 and 23 are open and, as a result, intake air streams E and F are admitted into the inside of the distributing device 6. Consequently, the flow rate of air in each branch conduit 14 and 15 remains the same as the flow rate in the main conduit 13.

In the operational position of FIG. 3*b*, the routing gate 19 is pivoted further away from the wall 6*b* and closes airtight the branch conduit 15 in cooperation with the dividing bulkhead 6*d* of the distributing device 6. Such a blockage of the branch conduit 15 also hermetically separates the air intake opening 23 from the main conduit 13 and the branch conduit 14, since the air intake opening 23 is situated in the branch opening 15. The routing gate 18, in contrast, is moved towards the wall 6*a* to lie flat thereagainst and thus hermetically closes the air intake opening 22. In this operational position the pneumatically conveyed fiber tuft stream passes solely through the branch conduit 14.

In the operational position of FIG. 3*c*, the routing gate 18 is pivoted further away from the wall 6*a* and closes airtight the branch conduit 14 in cooperation with the dividing bulkhead 6*d* of the distributing device 6. Such a blockage of the branch conduit 14 also hermetically separates the air intake opening 22 from the main conduit 13 and the branch conduit 15, since the air intake opening 22 is situated in the branch opening 14. The routing gate 19, in contrast, is moved towards the wall 6*b* to lie flat thereagainst and thus hermetically closes the air intake opening 23. In this operational position the pneumatically conveyed fiber tuft stream passes solely through the branch conduit 15.

As shown in FIGS. 3*b* and 3*c*, the air intake openings 22 and 23 are surrounded by a respective rubber or elastomer sealing ring 28 and 29 supported on the respective side walls 6*a* and 6*b*. In this manner an airtight closure of the air intake opening 22 by the routing gate 18 (FIG. 3*b*) or an airtight closure of the air intake opening 23 by the routing gate 19 (FIG. 3*c*) is obtained.

It will be understood that the above description of the present invention is susceptible to various modifications, changes and adaptations, and the same are intended to be comprehended within the meaning and range of equivalents of the appended claims.

What is claimed is:

1. A device for channeling a pneumatically conveyed fiber tuft stream, comprising (a) a housing defining a chamber;

(b) a main conduit merging into said chamber for guiding the fiber tuft stream into said chamber;

(c) first and second branch conduits extending from said chamber for guiding the fiber tuft stream out of said chamber;

(d) first and second air intake openings provided in said housing for allowing air, situated externally of said main conduit, to be drawn into said first and second branch conduits;

(e) a routing gate assembly disposed in said chamber and including first and second routing gates each having a surface cooperating with respective said first and second air intake openings; said routing gate assembly having a first operational state for channeling said flow from said main conduit simultaneously into said first and second branch conduits; a second operational state for channeling said flow from said main conduit solely into said first branch conduit; and a third operational state for channeling said flow from said main conduit solely into said second branch conduit; in said second and third operational states one of said first and second routing gates blocks directly one of said first and second air intake openings with said surface thereof;

(f) means for controlling positions of said first and second routing gates; and (g) a first seal provided between said first routing gate and said first air intake opening and a second seal provided between said second routing gate and said second air intake opening for providing an airtight closing of the respective said first and second air intake openings when covered by said surface of the respective said first and second routing gates; said first and second seals being supported in said housing and surrounding the respective said first and second air intake openings.

2. The device as defined in claim 1, further comprising means for pivotally securing said first and second routing gates to said housing.

3. The device as defined in claim 2, wherein said housing has first and second wall portions containing said first and second air intake openings, respectively; in said first state of said routing gate assembly said first and second routing gates being inclined at an acute angle to said first and second wall portions, respectively.

4. The device as defined in claim 2, further comprising at least one pneumatic power cylinder for pivoting said first and second routing gates.

5. The device as defined in claim 4, wherein said means for pivotally mounting said first and second routing gates comprises pivot pins; said pneumatic power cylinder being connected to at least one of said pivot pins.

6. A device for channeling a pneumatically conveyed fiber tuft stream, comprising (a) a housing defining a chamber;

(b) a main conduit merging into said chamber for guiding the fiber tuft stream into said chamber;

(c) first and second branch conduits extending from said chamber for guiding the fiber tuft stream out of said chamber;

(d) first and second air intake openings provided in said housing for allowing air, situated externally of said main conduit, to be drawn into said first and second branch conduits;

(e) a routing gate assembly disposed in said chamber and including first and second routing gates each having a surface cooperating with respective said first and second air intake openings; said routing gate assembly having a first operational state for channeling said flow from said main conduit simultaneously into said first and second branch conduits; a second operational state for channeling said flow from said main conduit solely into said first branch conduit; and a third operational state for channeling said flow from said main conduit solely into said second branch conduit; in said second and third operational states one of said first and second routing gates blocks directly one of said first and second air intake openings with said surface thereof;

(f) means for controlling positions of said first and second routing gates; and (g) means for varying a flow passage area of at least one of said first and second air intake openings; said means for varying said flow passage area including a slide shiftably mounted on said housing for covering said at least one air intake opening to a selected extent.

7. The device as defined in claim 6, where said first and second seals are of rubber.

8. The device as defined in claim 6, wherein said first and second seals are of an elastomer.

* * * * *